US005868318A

United States Patent [19]

Roman

[11] Patent Number: 5,868,318

[45] Date of Patent: Feb. 9, 1999

[54] WATER JET REGULATING CAP FOR WATER DELIVERY NOZZLE, PARTICULARLY FOR LAWN SPRINKLERS WITH OSCILLATING ARM

[75] Inventor: Gianfranco Roman, Pasiano, Italy

[73] Assignee: Claber S.p.A., Fiume Veneto, Italy

[21] Appl. No.: 825,211

[22] Filed: Mar. 27, 1997

[30] Foreign Application Priority Data

Mar. 28, 1996 [IT] Italy ..... MI960237 U

[51] Int. Cl.[6] ..... B05B 3/16

[52] U.S. Cl. ..... 239/242; 239/394; 239/436

[58] Field of Search ..... 239/390–5, 436, 239/242; 285/921

[56] References Cited

U.S. PATENT DOCUMENTS

| | | | |
|---|---|---|---|
| 1,968,391 | 7/1934 | Hamilton | 239/394 |
| 2,860,372 | 11/1958 | Youthed | 285/923 |
| 3,112,885 | 12/1963 | Bell et al. | 239/394 |
| 3,704,831 | 12/1972 | Clark | 239/394 |
| 3,711,029 | 1/1973 | Bartlett | 239/394 |
| 3,982,698 | 9/1976 | Anderson | 239/394 |
| 4,082,117 | 4/1978 | Peckham | 137/870 |
| 4,221,334 | 9/1980 | Christopher | 239/394 |
| 4,810,897 | 3/1989 | Shotey | 307/112 |
| 5,062,452 | 11/1991 | Johnson | 137/533.23 |
| 5,221,218 | 6/1993 | Marach | 439/637 |

FOREIGN PATENT DOCUMENTS

| | | |
|---|---|---|
| 0 671 782 A1 | 9/1995 | European Pat. Off. . |
| 2 091 049 | 7/1982 | United Kingdom . |

*Primary Examiner*—Andres Kashnikow
*Assistant Examiner*—Lisa Ann Douglas
*Attorney, Agent, or Firm*—Nixon & Vanderhye, P.C.

[57] ABSTRACT

A water jet regulating cap for a water delivery nozzle, for e.g., lawn sprinklers with an oscillating arm, comprises two parts of differing plastic materials tightly fixed together. A first part, formed of a rigid plastic material, has a sleeve-like shape and is attachable to the nozzle in such a way as to be held in an axial direction and revolvable around the axis of the nozzle between two end angular positions. A second part, formed of a soft plastic material, has a cup-like shape with a base through which extends an off-center hole which is selectively alignable with a corresponding off-center hole of the nozzle according to the angular position of the cap with respect to the nozzle.

3 Claims, 3 Drawing Sheets

WATER JET REGULATING CAP FOR WATER DELIVERY NOZZLE, PARTICULARLY FOR LAWN SPRINKLERS WITH OSCILLATING ARM

BACKGROUND OF THE INVENTION

1. Field of the Invention

The present invention deals with a water jet regulating cap for water delivery nozzle, particularly for lawn sprinklers with oscillating arm.

2. Related Art and other Considerations

Lawn sprinklers with oscillating arm, normally used for watering rectangular and square surfaces of lawns and gardens, accommodate a succession of nozzles positioned along an oscillating arm to produce a corresponding succession of water jets directed in an oscillating way towards respective portions of the lawn or garden to be watered.

The nozzles set up on the sides are often provided with a cap for the regulation of the water jet, which can be shifted manually from a position of maximum opening of water jet to a position of complete shut-off of the same for the purpose of varying the breadth of the area sprinkled.

According to a previous solution proposed by the applicant, the aforementioned regulating cap is made up of one piece of hard plastic material that is made to turn 180 degrees around the axis of the nozzle and is provided with an off-center hole that coincides or not with a corresponding off-centered hole in the nozzle depending on the angular position of the cap.

The rigidity of the plastic material used for the cap creates problems for liquid sealing when the cap is in the nozzle shut-off position.

In the light of this, the purpose of the present invention is to provide a cap for water-jet regulation for the water nozzle, particularly but not exclusively for oscillating arm sprinkler for gardening, which is able to solve the aforementioned sealing problems.

BRIEF SUMMARY OF THE INVENTION

According to the present invention the problem has been addressed by a water-jet regulating cap formed by two parts made up of different plastic materials tightly fixed together. A first part is made of a rigid plastic material having a sleeve-like shape and is attachable to the nozzle in such a way as to be held in the axial direction and revolvable around the nozzle axis between two end angular positions. A second part is made of a soft plastic material having a cup-like shape with a base passed through by an off-center hole, that is alignable or non-alignable with a corresponding off-center hole in the nozzle depending on the angular position of the cap with respect to the nozzle.

While the first part of rigid plastic material (for instance polypropylene) assures the necessary steady revolvable coupling of the cap to its respective nozzle, the second part made up of a soft plastic material (for instance thermoplastic rubber) guarantees the desired water-tight containment between the cap and the off-center hole of the nozzle when said cap is in the nozzle shut-off position. In other words, the second part of soft plastic material acts like a water-tight washer completely closing off the off-center hole of the nozzle when the off-center hole of the cap is not in alignment with it.

BRIEF DESCRIPTION OF THE DRAWINGS

The features of this invention will be made even more clear by the following detailed description of an embodiment thereof illustrated in the attached drawings, in which.

DETAILED DESCRIPTION OF THE DRAWINGS

Figure 1:
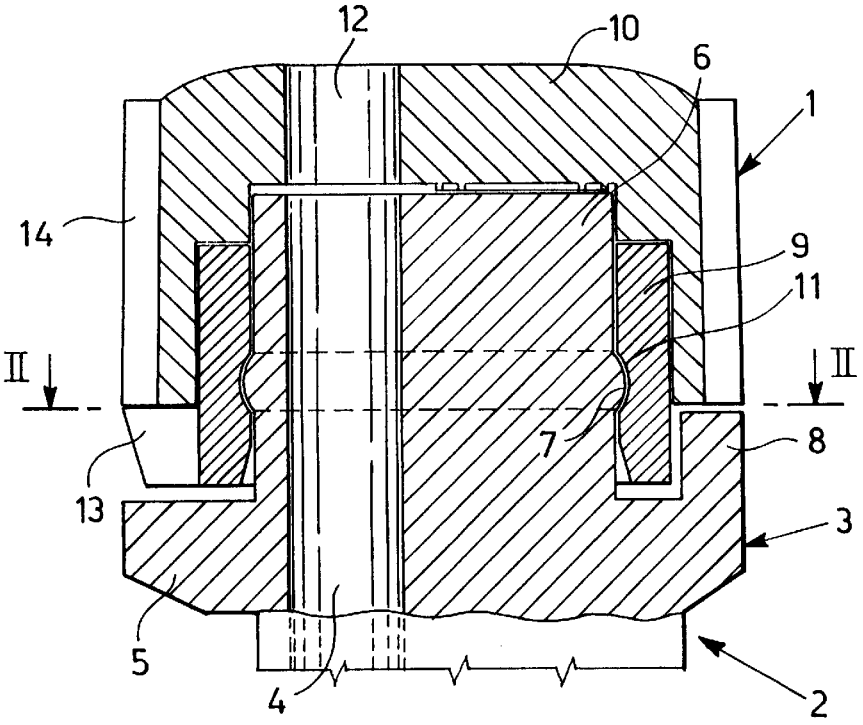
FIG. 1 shows a liquid delivery nozzle, for instance for oscillating arm sprinklers for lawns and gardens, which is provided with a cap for water jet regulation according to this invention, the whole group being shown in axial section along line I—I of FIG. 2, with the cap in complete shut-off of water jet.
Figure 2:
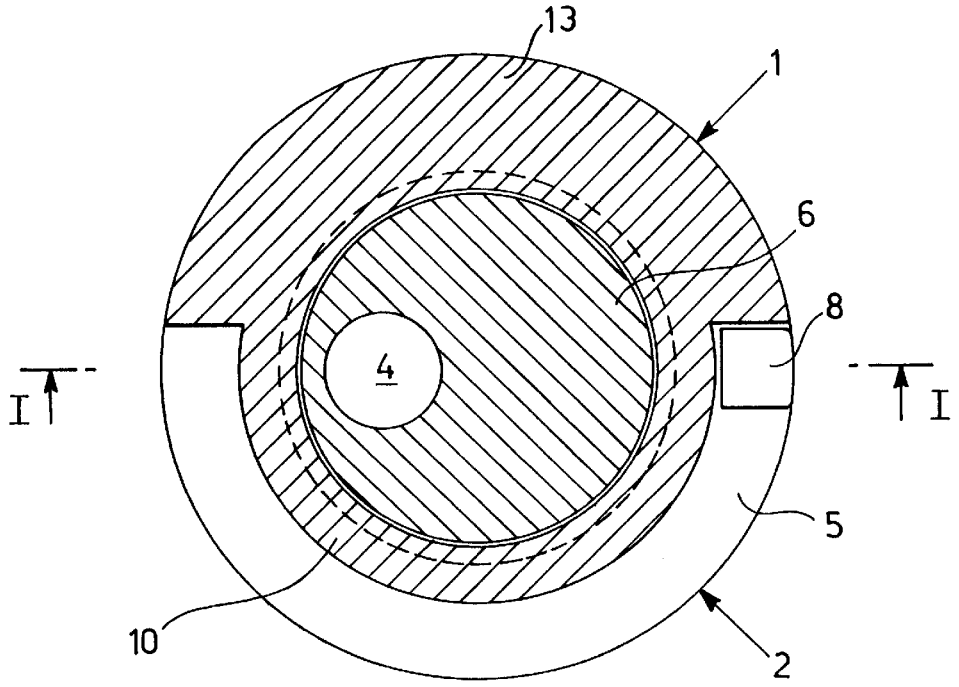
FIG. 2 shows the same group in transversal cross-section along line II—II of FIG. 1.

In FIGS. 1 and 2, a cap 1 according to the invention is shown in open position attached to a water delivery nozzle 2, for example comprising one of the water delivery nozzles of a sprinkler oscillating arm.

Nozzle 2 comprises a body 3, usually in plastic material, axially crossed by an off-center cylindrical hole 4 that constitutes the pipe for the flow of water.

Body 3 is formed by base part 5 and by a cylindrical tang 6, the latter provided with an external ring-like convex protrusion 7. Base 5 has an axially protruding tooth 8.

Figure 3:
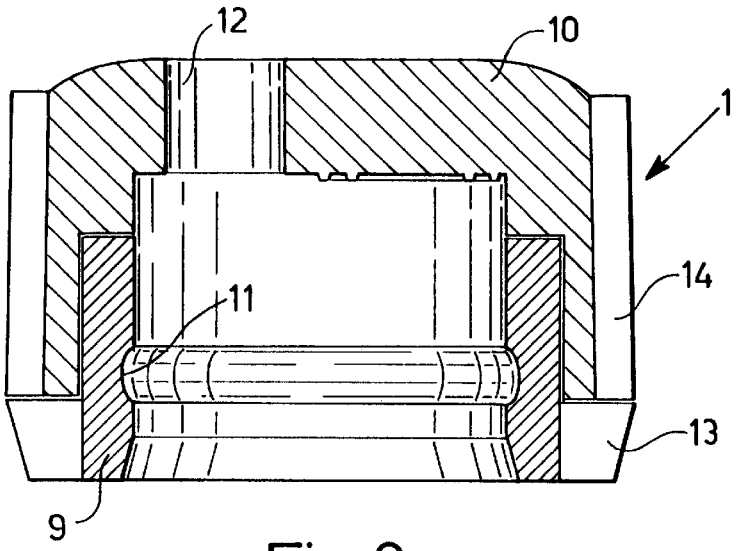
FIG. 3 shows only the cap in axial cross-section along line III—III of FIG. 4.
Figure 4:
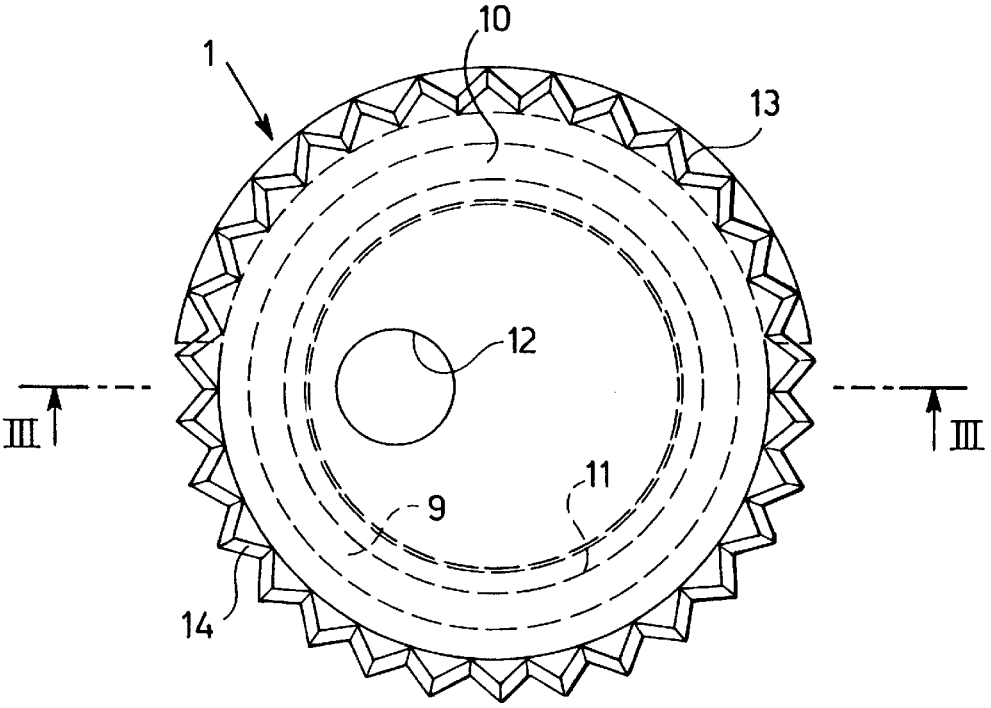
FIG. 4 shows the cap in plane view from above.

Cap 1, better illustrated in FIGS. 3 and 4, is made up of two parts 9 and 10 tightly fixed together.

A first part 9 comprising of a rigid plastic sleeve, for example polypropylene, that is provided with an internal ring-like concave groove 11 which snaply receives the external ring-like convex protrusion 7 of tang 6 of nozzle 2 in such a way as to prevent the axial slipping of the cap from the nozzle, at the same time allowing the cap to turn around the nozzle axis.

A second part 10 of cap 1 comprises a cup-shaped body made of soft plastic material, for instance thermoplastic rubber. The base of cup-shaped piece 10 is crossed by an off-center cylindrical hole 12, that is aligned or non-aligned with the corresponding off-center hole 4 of the nozzle depending on whether cap 1 is found in one or the other of two end angular positions with respect to nozzle 2.

The aforementioned end angular positions are shown in FIGS. 1–2 and 5–6 and are secured by the engagement of a protruding angular sector 13 of the cup-shaped body 10 with the tooth 8 of base 5 of nozzle 2. When cap 1 is in the open angular position of FIGS. 1 and 2, the two holes 12 and 4 are in alignment with each other and the water flowing into nozzle 2 can come out freely through hole 12.

Figure 5:
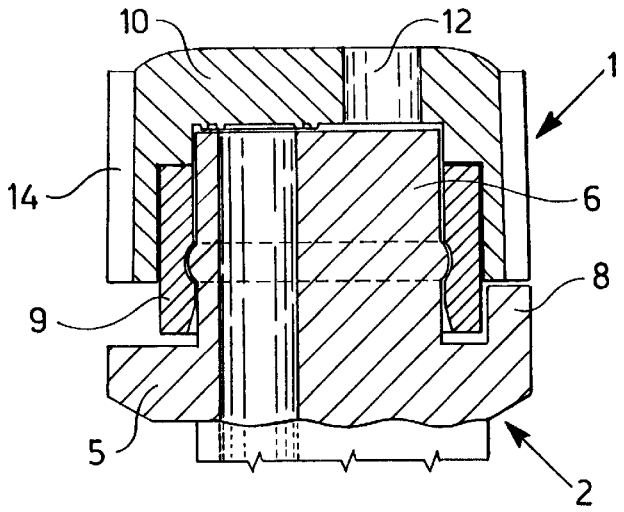
FIG. 5 shows the nozzle together with cap, sectioned as in FIG. 1 but with the cap rotated in position of complete water jet shut-off.
Figure 6:
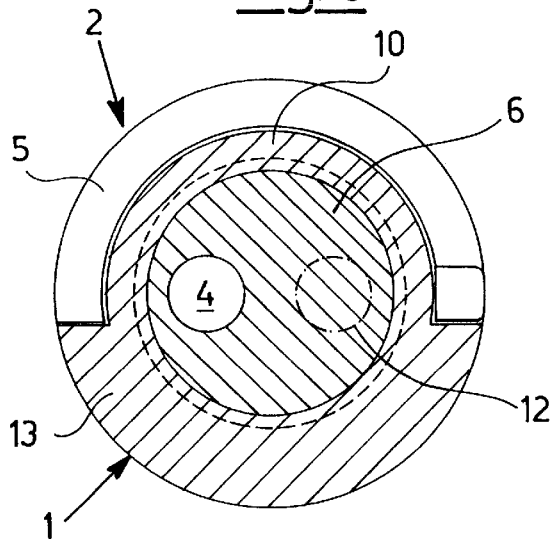
FIG. 6 shows a cross-section view of the nozzle with cap as in FIG. 2, with the cap rotated in position of complete shut-off of water jet.

When, however, cap 1 is in the angular shut-off position of FIGS. 5 and 6, the two holes 12 and 4 are not in alignment and the soft material of the cup-shaped body 10 exerts an efficacious water-tight shut-off for nozzle 2.

Knurting 14 of the cup-shaped piece 10 makes an easier manual rotation of the cap from one to the other of the aforementioned end angular positions.

Figure 7:
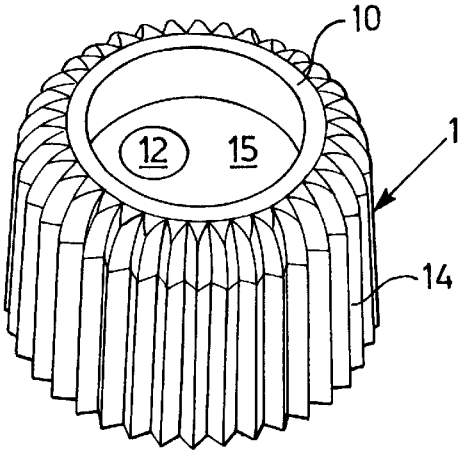
FIG. 7 shows, in perspective view, an alternative embodiment of the cap for water jet regulation.

In FIG. 7 a variant of the cap is illustrated that differs from the previously described embodiment only due to the fact that the base of the cup-shaped body 10 has a cylindrical cavity 15 into which the off-center hole 12 opens.

I claim:

1. A water jet regulating cap for water delivery nozzle for a lawn sprinkler with an oscillating arm, the cap comprising two parts formed of different plastic materials tightly fixed together, a first of the two parts being made of a rigid plastic material having a sleeve-like shape and being attachable to the nozzle so as to be held in an axial direction and turned around the axis of the nozzle between two end angular positions, a second of the two parts being made of a soft plastic material having a cup-like shape with a base crossed by an off-center hole alignable or non-alignable with a corresponding off-center hole in the nozzle according to the angular position of the cap with respect to the nozzle, wherein the said sleeve-shaped part of the cap is attachable to the nozzle by snap means able to permit the rotation of the cap around the axis of the nozzle and to prevent an axial slipping out of the same.

2. The apparatus of claim 1, wherein said snap means comprise an internal coverage ring-like groove of the sleeve-like part of the cap that is adapted to accommodate a corresponding external convex ring-like protrusion of the nozzle.

3. A water jet regulating cap for water delivery nozzle for a lawn sprinkler with an oscillating arm, the cap comprising two parts formed of different plastic materials tightly fixed together, a first of the two parts being made of a rigid plastic material having a sleeve-like shape and being attachable to the nozzle so as to be held in an axial direction and turned around the axis of the nozzle between two end angular positions, a second of the two parts being made of a soft plastic material having a cup-like shape with a base crossed by an off-center hole alienable or non-alienable with a corresponding off-center hole in the nozzle according to the angular position of the cap with respect to the nozzle, wherein said end angular positions of the cap are secured by engagement of a protruding angular sector of said cup-like piece of the cap with a protruding tooth of the nozzle.

* * * * *